United States Patent [19]

Evans

[11] Patent Number: 4,869,309

[45] Date of Patent: Sep. 26, 1989

[54] LOUVER HOLDER FOR VERTICAL VENETIAN BLINDS

[75] Inventor: J. Richard Evans, Nassau, The Bahamas

[73] Assignee: Design 2000 Limited, Nassau, The Bahamas

[21] Appl. No.: 205,651

[22] Filed: Jun. 13, 1988

[30] Foreign Application Priority Data

Nov. 24, 1987 [CA] Canada ..... 5526655

[51] Int. Cl.[4] ..... E06B 9/38

[52] U.S. Cl. ..... 160/177; 160/900

[58] Field of Search ..... 160/168.1, 176.1, 177, 160/900

[56] References Cited

U.S. PATENT DOCUMENTS

| | | | |
|---|---|---|---|
| 2,631,339 | 3/1953 | Pratt | 160/177 X |
| 2,807,322 | 9/1957 | Toti . | |
| 3,055,420 | 9/1962 | Del Faro et al. . | |
| 3,378,879 | 4/1968 | Stall . | |
| 3,916,975 | 11/1975 | Lawson . | |
| 3,996,988 | 12/1976 | de Wit | 160/176.1 X |
| 4,102,381 | 7/1978 | Bratschi . | |
| 4,103,727 | 8/1978 | Spohr . | |
| 4,122,884 | 10/1978 | Salzmann . | |
| 4,193,438 | 3/1980 | Pastore | 160/168.1 |
| 4,257,470 | 3/1981 | Woodle | 160/900 X |
| 4,262,728 | 4/1981 | Debs . | |
| 4,267,875 | 5/1981 | Koks | 160/168.1 X |
| 4,335,775 | 6/1982 | Frentzel et al. | 160/176.1 |
| 4,425,955 | 1/1984 | Kaucic . | |
| 4,525,893 | 7/1985 | Fukada . | |
| 4,559,670 | 12/1985 | Wyatt . | |
| 4,628,981 | 12/1986 | Ciriaci et al. | 160/176.1 |
| 4,732,202 | 3/1988 | Anderson | 160/177 X |
| 4,759,397 | 7/1988 | Walther | 160/176.1 X |

*Primary Examiner*—Ramon S. Britts
*Assistant Examiner*—David G. Kolman
*Attorney, Agent, or Firm*—Fleit, Jacobson, Cohn, Price, Holman & Stern

[57] ABSTRACT

In venetian blinds, a combination of a louver clip and a louver sleeve for supporting a louver. The louver sleeve has a cylindrical opening with an obstrusion on the lower part of its periphery having a cross-section in the form of a segment. The louver clip comprises a shank and a stem on top of the shank. The stem is adapted to be introduced in the sleeve. The stem has a longitudinal axial flat adapted to match the flat side of the obstrusion. The stem is provided with an aperture in its upper portion extending through the axial flat. An anchor tab extends from the top of the stem and projects downwardly in the aperture and angularly so as to project outside the contour of the stem. When the stem is introduced in the sleeve, the tab catches the top surface of the obstrusion, which acts as a support for the stem. The advantage of this combination resides in the fact that if the shank breaks away from the stem, another clip is used to push the broken stem out of the sleeve. The anchor tab of this new clip catches the top surface of the obstrusion and fits as the original clip.

5 Claims, 2 Drawing Sheets

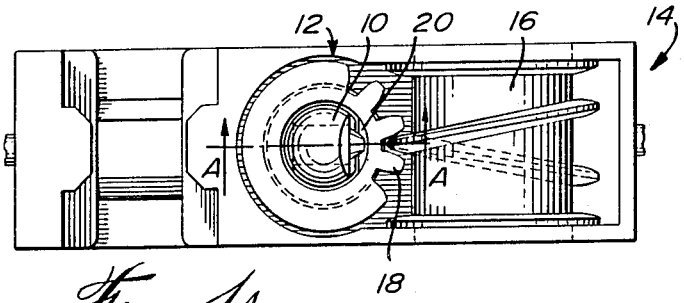
Fig. 1A
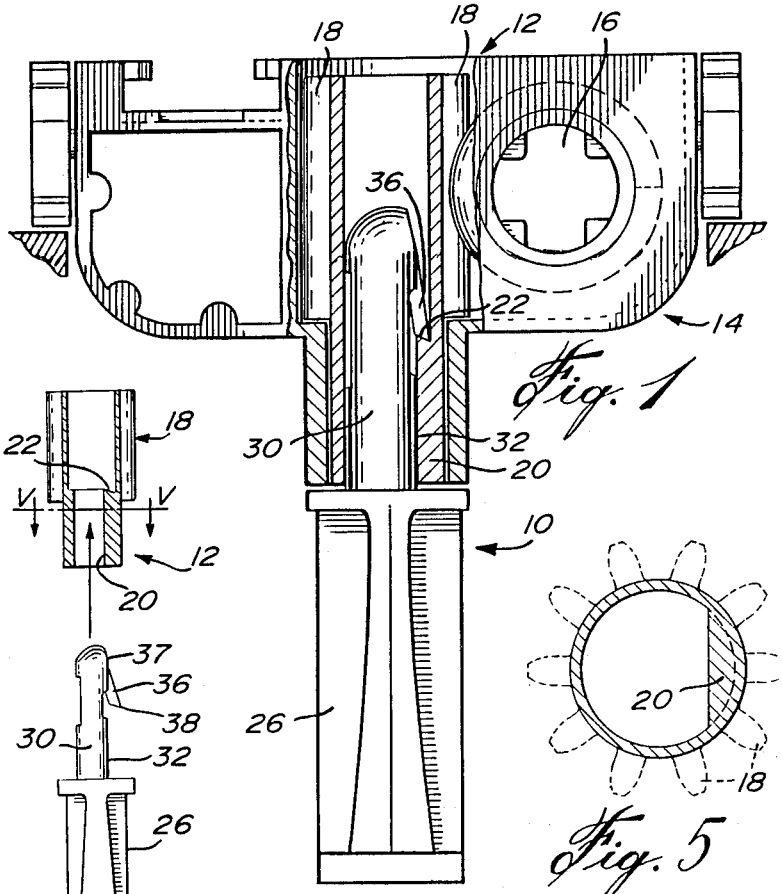
Fig. 1
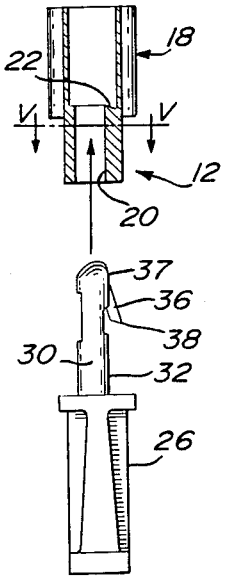
Fig. 2
Fig. 5

LOUVER HOLDER FOR VERTICAL VENETIAN BLINDS

BACKGROUND OF THE INVENTION

1. Field of the Invention

The invention relates to venetian blinds having vertical louvers supported by carriers adapted to move sideways in a head rail. Each carrier is provided with a mechanism which allows it to be pulled in both lateral directions and with means for rotating each suspended louver around its vertical axis. This means comprises an externally toothed louver sleeve and a louver clip supported in the sleeve. A worm gear in the carrier acts on the toothed sleeve to rotate it with the louver clip. The present invention is particularly directed to the combination of the toothed sleeve and the louver clip in which the louver clip can be easily replaced if broken.

2. Prior Art

Venetian blinds having suspended vertical louvers are well known.

In U.S. Pat. No. 2,807,322 to Toti, the louvers are supported by a louver holder consisting of a cylindrical shaft having a ball-like head at its upper end. The shaft with the head is mounted between plates held together by rivets. If the shaft breaks, another one cannot be introduced between the plates without unriveting the plates.

In U.S. Pat. No. 4,103,727 to Spohr, the louver holder has a cross-section which is wider at the top and at the bottom. It is squeezed at the neck by the sleeve or bush around it. If the louver holder breaks, it cannot be pulled down or pushed upwardly.

In U.S. Pat. No. 4,335,775 to Frentzel et al. the louver holder is supported in a sleeve designed to prevent breakage when an externally exerted force of unduly high value tends to rotate the louver. This arrangement requires the production of intricate and more expensive parts to protect what is normally of negligible value.

BRIEF SUMMARY OF THE INVENTION

In venetian blinds having vertical louvers, each louver is rotatably supported individually by a clip which is actuated by a carrier through a toothed sleeve. A plurality of carriers are slidably mounted on a rail. The louvers are usually long slats which may be unintentionally twisted, bent or pulled downward. This pulling, twisting or bending action is absorbed by a usually small and delicate clip. Although the clip has all the required strength to withstand a normal shock, it may break in the case of abnormal use.

When breakage of the clip happens, it is not unusual in existing venetian blind arrangements to have to take the whole rail down to have access to the louver carrier. Only under such conditions is it possible to remove the broken part which is left inside the toothed sleeve in the carrier.

In order to overcome such an inconvenience, the louver holder according to the present invention is constructed in such a way that when the clip holding the louver breaks, the stem which is left is in the louver sleeve can be pushed out of place by merely introducing another clip in the same sleeve.

In order to achieve such a result, a new sleeve and a new clip are contemplated. The sleeve has a tubular opening therethrough with an obstrusion member along part of its length at the lower part thereof, the obstrusion member having a cross-sectional segment. The clip holding the louver has a tubular stem at its upper end with a longitudinal axial flat on its periphery. The cross-section of said stem corresponds to the tubular opening of the sleeve, so that the axial flat prevents the rotation of the stem in the sleeve. A recess is provided in the upper part of the stem and in line with the axial flat of said stem. An anchor tab is secured to the upper part of the stem and extends downwardly in the recess and angularly so as to project partly outside the periphery of the stem.

The introduction of the stem into the sleeve can be done when the tab is in line with the segment. In its operating position, the said tab abuts on the top surface of the obstrusion member.

BRIEF DESCRIPTION OF THE DRAWINGS

FIG. 1 illustrates a louver carrier having a cut-out showing a louver holder according to the invention, FIG. 1A is a plan view of the louver carrier, FIG. 2 is a side view of a louver clip and a louver sleeve, FIG. 5 is a cross-sectional view along line V—V of FIG. 2 and, FIGS. 6, 7 and 8 are a sequence of views showing the louver clip at different replacement stages with the louver sleeve in cross-section.

DETAILED DESCRIPTION OF THE INVENTION

Figure 6:
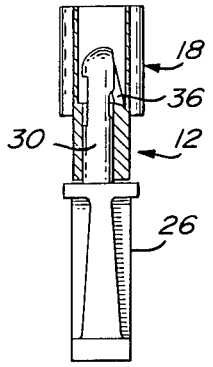

The novelty of the present invention resides in the novel construction and coupling arrangement of the louver clip 10 with the louver sleeve 12. The louver sleeve 12 is mounted in the louver carrier 14, as shown in FIG. 1. The carrier is of a known type which is generally illustrated in U.S. Pat. No. 4,559,670. A worm gear 16 is used to rotate the sleeve 12 which is provided on the upper part of its outer periphery with vertical longitudinal ribs 18. The worm gear 16 engages the longitudinal ribs 18 and results in the desired rotation of the louvers as generally described in the patents referred to above.

The sleeve 12 according to the invention has a partial obstrusion having a cross-section in the form of a segment 20 secured to the inner periphery of the sleeve 12. This obstrusion extends over the lower portion of the sleeve and provides a top resting surface 22 which will be referred to later.

The louver clip 10 has a shank portion 26 adapted to support a louver 28. A stem 30 extends from the shank 26 and is generally cylindrical, with a contour smaller than the shank. The diameter of the stem is substantially uniform and has a longitudinal flat 32 on one side adapted to face the segment for preventing rotation of the stem in the sleeve 12. The stem is perforated across its upper portion and the perforation 34 opens up across the flat 32. An anchor tab 36 extends downwardly and angularly from the top portion of the stem into the perforated area 34. The lower ledge of the tab 36 projects outwardly of the plane of the flat 32 but is resilient so that an outer pressure on the tab 36 can make it retract into the perforation 34. Although the stem 30 has been described with a perforation 34 completely extending through its diameter, a recess extending through only a portion of the diameter could be sufficient, as long as the recess is deep enough to receive the tab 36 when the latter is pushed inward.

In operation, the sleeve 12 is partly inserted in the carrier 14 so that the longitudinal ribs 18 are facing the worm gear 16 for rotation of the sleeve 12. Afterwards, the louver clip 10 is inserted in the sleeve 12, as seen in the sequence of coupling stages shown in FIGS. 2, 6 and 8. To facilitate the orientation of the stem 30 when it is inserted in the sleeve, the outer surface of the anchor tab 36 is flat and merges with a sloping flat surface 37 extending towards the apex of the stem. The flat surface 37 is in line with the longitudinal flat 32. The anchor tab 36 sits on the top surface of the segment 20 and is intended to support a weight which well exceeds all normal occurrences. In order to prevent damage to the carrier 14 or other components supporting the carrier, when excessive pulling traction is applied to the louver 28, the walls 35 of the stem 30 on each side of the perforation 34 are reduced in thickness to correspond to a predetermined traction limit. It has been found that the thickness of the walls may be adjusted to sustain a pull varying from 30 to 50 pounds before the walls 35 break. It has been found that the preferred weight range is 40 to 45 pounds. This predetermined breakage point allows the rail to remain in place without significant alteration in its operation.

Figure 7:
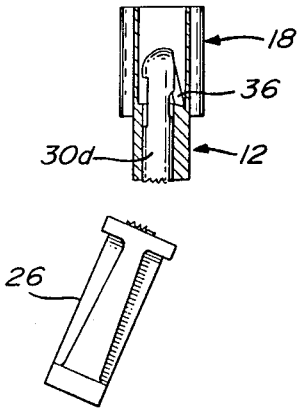
Figure 8:
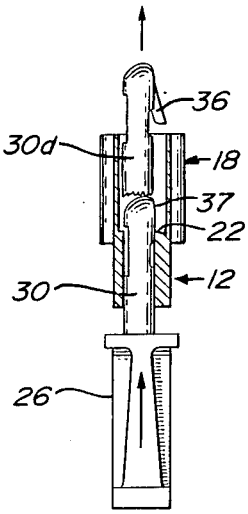
Figure 3:
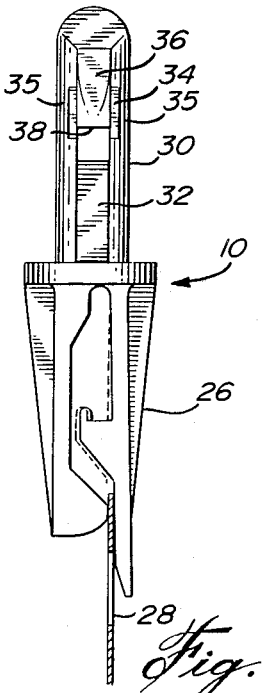
FIG. 3 is a side view of the louver clip taken at 90° with the view shown in FIG. 2 with a portion of a louver hanging from it.
Figure 4:
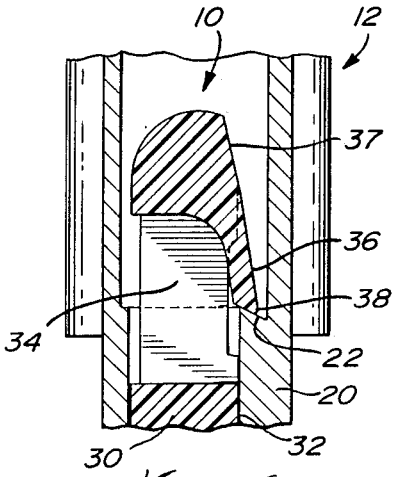
FIG. 4 is a cross-sectional view of a portion of the louver sleeve with the head of the louver clip inserted therein, along the line of A—A of FIG. 1A.

As shown in FIG. 7, it may happen that the shank 26 breaks away from the stem 30 because it is not pulled down evenly or because it is forcefully rotated. The advantage of the present invention is that one does not have to bring down the rail and remove the whole carrier in order to remove the broken stem **30*d*, as illustrated in FIG. 7. One has only to introduce the stem of a new louver clip in the sleeve to push out of the way the broken stem 30*d*, as shown in FIG. 8. The new clip sets in place with its anchor tab 36 hooked to the top surface 22 of the segment 20, as shown in FIG. 4**.

Because the anchor tab 36 projects outside the circumference of the stem 30, the introduction of the latter in the sleeve 12 exerts an upward pressure on the sleeve. If this pressure exceeds a certain limit, the sleeve may have a tendency to move out of its socket, although it is partly retained by the worm gear 16. A tool in the form of a hook may be used momentarily to hold the top surface of the sleeve while the clip 10 is pushed upwardly.

The embodiments of the invention in which an exclusive property or privilege is claimed are defined as follows:

1. A louver holder comprising a louver sleeve extending along the height of the holder and a louver clip adapted to be partly inserted into the lower end of said sleeve, said sleeve having an axial cylindrical opening extending throughout the sleeve, an obstrusion member fixed on the internal periphery of said opening in the lower part thereof, said obstrusion member having a cross-section in the shape of a segment and forming a shoulder surface at its upper end, said louver clip comprising a shank and a stem, said stem being generally of a uniform cylindrical shape with a longitudinal axial flat on one side adapted to fit into said opening, said shank defining a shoulder around the periphery of said stem for abutting against the lower end of said sleeve, said flat being adapted to face said segment for preventing said stem from rotating in said sleeve, said stem being provided with a recess through said flat at the upper end thereof, a resilient anchor tab fixed to said stem at the upper part thereof projecting downwardly in said recess and angularly so that the lower end of said tab extends outwardly of the plane of said flat of the stem, said tab adapted to become inserted in said recess when the stem is pushed upwardly into the sleeve, said louver slip being adapted to be supported by said tab resting by gravity on said shoulder surface of said obstrusion member, whereby, when said stem is broken off said shank about said shoulder, said stem can be pushed up outwardly of said opening by the stem of a substitute louver clip.

2. A louver holder as in claim 1, wherein said recess extends completely through the center part of said stem to form an opening, said stem being provided by lateral walls on each side of said opening, the thickness of said walls having a predetermined size.

3. A louver holder as in claim 1, wherein the top surface of said anchor tab is flat and extends from the apex of said stem to facilitate the correct orientation of the stem for its penetration in said sleeve.

4. A louver holder as in claim 2, wherein the predetermined wall thickness is capable of sustaining a downward pull of about 30 to 55 pounds without breaking.

5. A louver holder as in claim 2, wherein the predetermined wall thickness is capable of sustaining a downward pull of about 40 to 45 pounds without breaking.

* * * * *